United States Patent [19]

Nakamura

[11] 4,057,937

[45] Nov. 15, 1977

[54] WINDOW SASH ASSEMBLY

[75] Inventor: Yoshihiro Nakamura, Shizuoka, Japan

[73] Assignee: Riken Keikinzoku Kogyo Kabushiki Kaisha, Shizuoka, Japan

[21] Appl. No.: 691,829

[22] Filed: June 1, 1976

[30] Foreign Application Priority Data

May 30, 1975 Japan ..... 50-74074
Feb. 3, 1976 Japan ..... 51-11646

[51] Int. Cl.[2] ..... E05F 11/38

[52] U.S. Cl. ..... 49/372; 160/37; 160/90

[58] Field of Search ..... 49/372, 374, 378, 376, 49/377; 160/37, 90

[56] References Cited

U.S. PATENT DOCUMENTS

| | | | |
|---|---|---|---|
| 1,442,397 | 1/1923 | Gorrani | 49/372 X |
| 1,785,663 | 12/1930 | Wittmann | 160/37 |
| 2,355,803 | 8/1944 | Hopewell | 160/37 X |
| 3,003,200 | 10/1961 | Hansen | 49/372 |
| 3,440,766 | 4/1969 | Hepenstall | 49/372 |

*Primary Examiner*—Philip C. Kannan
*Attorney, Agent, or Firm*—Dennison, Dennison, Meserole & Pollack

[57] ABSTRACT

Disclosed is a window sash assembly for use on an exterior surface at a window opening. The assembly comprises a rectangular framework formed by an upper horizontal frame member, a lower horizontal frame member and a pair of vertical frame members. The framework includes a window covering portion facing the window opening and at least one window panel housing portion on the exterior wall surface alongside the window opening. The sash assembly includes at least a pair of window panels which are retractable into the window panel housing portion to fully open the window opening.

13 Claims, 10 Drawing Figures

S2
X
Y
W
203
204
205A
205B
206
207
208
209
210
240A
241
248
249
250
251
260
261
262
272
274
277
279
286
287
288
289
290
291
292
293
294
295
296
297
298
299
300
301
302
303
304
305
306
307
308
309
310
311
312
313
314
315
316
317
318
319
320
321
322
323
324
325
326
332
333
334
335
336
339
340
341
342
343
344
345
346
347
348
349
350
353
355
356
359
360
362
363
364
365
366
367

WINDOW SASH ASSEMBLY

This invention relates to a window sash assembly and more particularly, to a window sash assembly suited for mounting on an exterior wall surface at a window opening in such a manner that the window opening may be opened to its full width without being obstructed by any glazed window panel, screen or shutter.

A typical window sash assembly of this sort known in the art does not permit the window opening to be fully opened. Even when the window is opened to its full possible extent, at least one window panel remains in front of the window opening and undesirably keeps the window opening closed in part. In order to fully open the window opening, it is essential to dismount all of the window panels, shutters or the like. It is necessary to replace the window panels or the like in order to close the window opening. This is a cumbersome and hard work because the window panels and the like are heavy in weight. Moreover, it is necessary to move the window panels or the like from one side to another in order to change the open area of the window opening.

It is, therefore, a general object of this invention to eliminate the aforementioned drawbacks of the window sash assembly known in the art for use on an exterior wall surface at a window opening.

It is an object of this invention to provide a novel and improved window sash assembly for use on an exterior wall surface at a window opening, which is designed and installed in such a manner as to permit the window opening to be opened to its full width.

It is another object of this invention to provide a novel and improved window sash assembly which is easy to manufacture and install at a window opening.

It is a further object of this invention to provide a novel and improved window sash assembly which is easy to operate to open the window opening to its full width.

According to this invention, there is provided a window sash assembly for use on an exterior wall surface at a window opening, comprising a rectangular framework formed by an upper horizontal frame member, a lower horizontal frame member and a pair of vertical frame members, the framework including a window panel housing portion facing the wall surface on at least one side of the window opening, the housing portion being capable of receiving therein at least one window panel when the window opening is fully opened.

The invention will now be described by way of example with reference to the accompanying drawings, in which.

Figure 1:
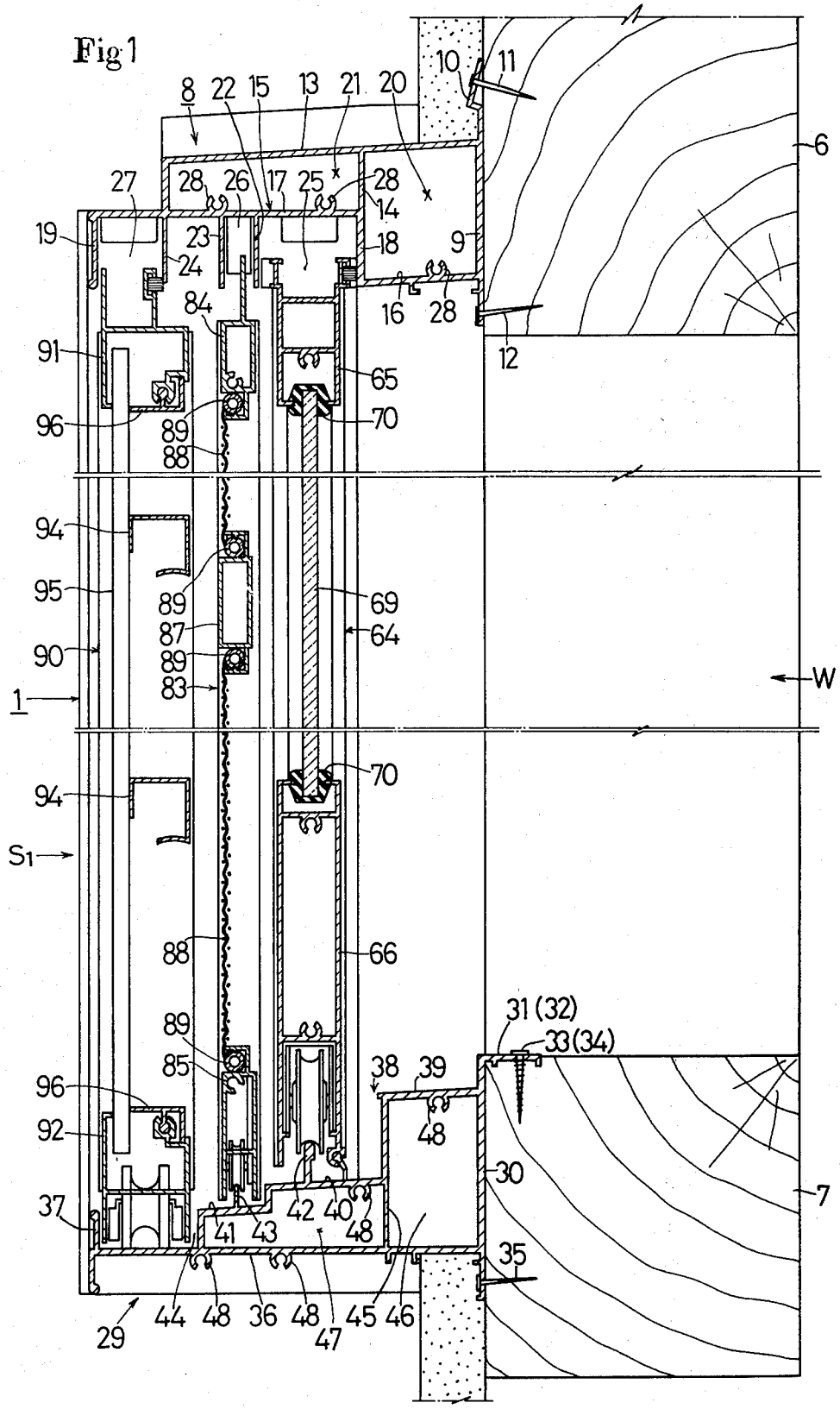
FIG. 1 is a partial vertical cross sectional view of one embodiment of this invention.
Figure 2:
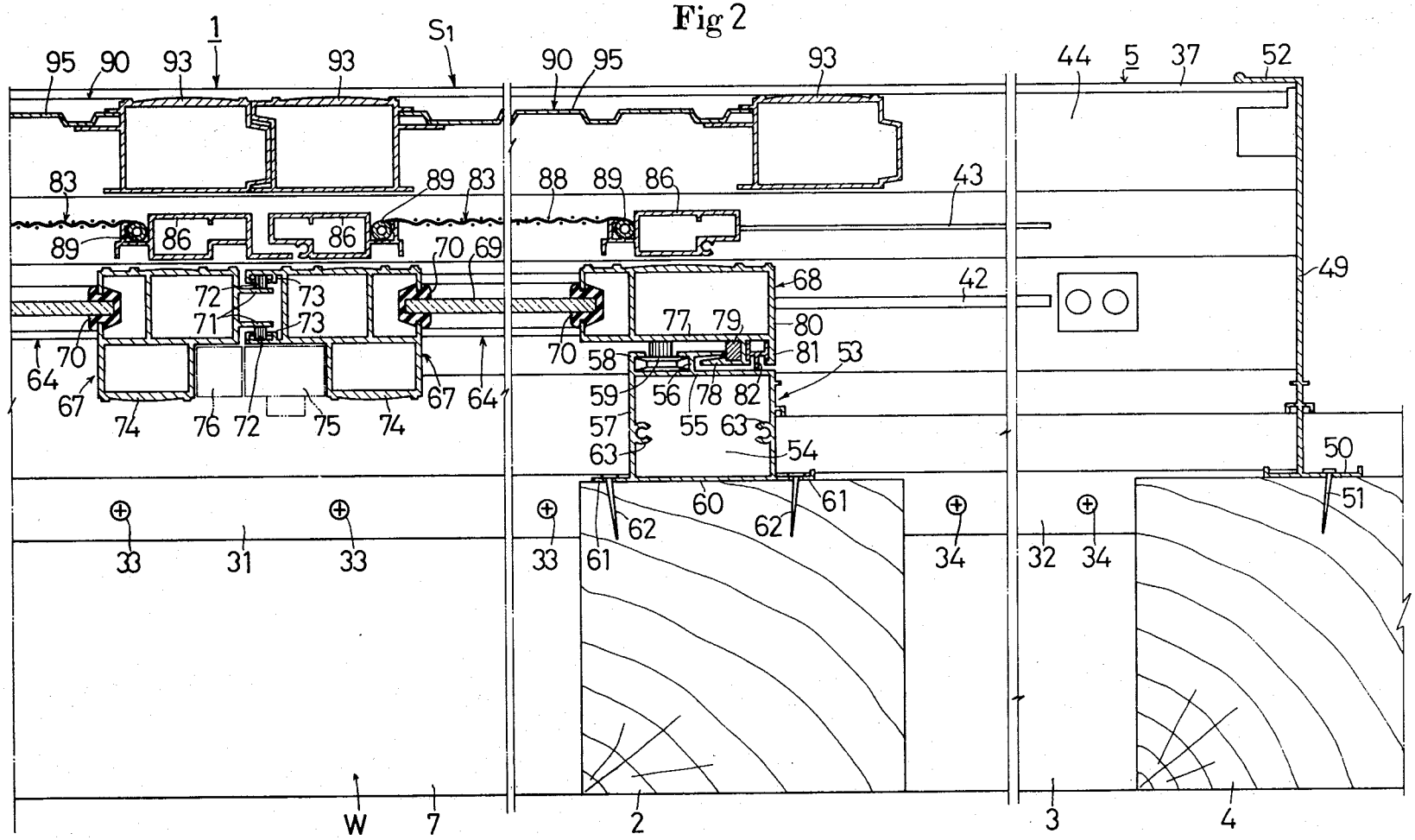
FIG. 2 is a partial horizontal cross sectional view of the structure shown in FIG. 1.

Referring to FIGS. 1 and 2 illustrating a first embodiment of this invention, there is shown a window sash assembly $S_1$ mounted on an exterior wall surface at a window opening W. The window sash assembly $S_1$ is of such type that the window opening can be fully opened when a or each pair of window panels or screens are moved away from each other, while it is closed when they are moved toward each other. FIG. 1 shows a vertical cross section of the sash assembly $S_1$ mounted at the window opening W. In FIG. 1, the outdoor side of the window is shown at left and the indoor side thereof at right. FIG. 2 shows a horizontal cross section of the sash assembly $S_1$, of which the outdoor side is shown at top, while its indoor side appears at bottom.

The window sash assembly $S_1$ comprises a window covering portion 1 positioned on the outdoor side of the window opening W, and a pair of window panel housing portions 5 connected to the opposite side edges of the window covering portion 1. Each window panel housing portion 5 extends along a wall 3 between a post 2 at the perimeter of the window opening W and another post 4 remote from the window opening W as shown in FIG. 2. In FIG. 1, a lintel or head jamb is shown at 6 and a windowsill at 7.

The sash assembly $S_1$ includes an upper frame 8 secured to the outer surface of the lintel 6 and extending outwardly therefrom. The upper frame 8 further extends along the length of the lintel 6 to define a roof for the window covering portion 1 and the window panel housing portions 5. The upper frame 8 includes a vertically extending base portion 9 placed against the outer surface of the lintel 6. The base portion 9 has an upper edge 10 bent outwardly and then inwardly, so that the upper edge 10 contacts the lintel 6 at an angle thereto as clearly shown in FIG. 1. The upper edge 10 is secured to the lintel 6 by a nail 11 and the base portion 9 further includes a lower edge secured to the lintel 6 by a nail 12.

The upper frame 8 has a head member 13 having an inner end joined to the base portion 9. The head member 13 is slightly inclined outwardly and downwardly and has an outer end bent downwardly and joining a slide web 17. A reinforcing partition 14 depends downwardly from the underside of the head member 13 and the slide web 17 has an inner edge joined to the partition 14.

The upper frame 8 further includes a bottom member 15 of which the slide web 17 forms a part, and which includes a base web 16 located at a lower level than the slide web 17 and connected to the slide web 17 by a vertical connecting member 18. The base web 16 has an inner edge joined to the base portion 9 in the vicinity of the latter's lower edge, and is slightly inclined outwardly and downwardly until its outer edge is connected to the bottom edge of the connecting member 18. The slide web 17 extends horizontally and outwardly beyond the outer edge of the head member 13 and has a downwardly bent outer edge 19. The upper frame 8 thus includes a hollow space 20 of generally square cross section defined by the base portion 9, the partition 14, the base web 16 and the connecting member 18, and another hollow space 21 of generally rectangular cross section defined by the head member 13, the partition 14 and the slide web 17.

Three partitions 22, 23 and 24 having an equal width depend down from the underside of the slide web 17. The first partition 22 and the connecting member 18 define therebetween a first sliding groove 25 for glazed window panels. The first and second partitions 22 and 23 define therebetween a second sliding groove 26 for screen windows, and the outer edge 19 of the slide web 17 and the third partition 24 define therebetween a third sliding groove 27 for shutters or storm windows.

A number of longitudinally extending raised grooves 28 are provided on the upper surface of the bottom member 15.

The sash assembly $S_1$ further comprises a lower frame 29 secured to the outer surface of the windowsill 7 and extending outwardly from the windowsill 7. The lower frame 29 extends along the outer surface of the windowsill 7 and forms a floor for the window covering portion 1 and the window panel housing portions 5. The lower frame 29 includes a base portion 30 contacting the outer surface of the windowsill 7. The base portion 30 includes an inwardly bent upper edge 31 extending between the posts 2 and contacting the upper surface of the windowsill 7. The upper edge 31 is secured to the windowsill 7 by screws 33. The base portion 30 further includes a pair of upper edge extensions 32 which are also inwardly bent and extend horizontally. Each upper edge extension 32 extends along the wall 3 between the posts 2 and 4 and is secured to the windowsill 7 by screws 34. The base portion 30 has a lower edge secured to the outer surface of the windowsill 7 by nails 35.

The lower frame 29 comprises a bottom member 36 having an inner edge joined to the base portion 30. The bottom member 36 extends horizontally and outwardly from the base portion 30 and terminates in an outer edge lying in the vertical plane of the outer edge 19 of the upper frame 8 in which the bottom member 36 is bent both upwardly and downwardly to form its outer edge 37. The lower frame 29 further comprises a head member 38 of outwardly and downwardly stepped construction which includes an inner portion 39 having an inner edge joined to the base portion 30. The outer edge of the inner portion 39 is downwardly bent to define a first slide web 40 having an inner edge connected to the inner portion 39 at a level below the inner portion 39. The first slide web 40 has an outer edge downwardly bent to define a second slide web 41 which in turn has an outer edge joined to the bottom member 36.

The first slide web 40 is located below the first sliding groove 25 and includes an upright rail 42 extending longitudinally of the lower frame 29. Likewise, the second slide web 41 is positioned below the second sliding groove 26 and includes an upright rail 43 for screen windows extending in parallel to the first rail 42. The bottom member 36 defines a lower sliding groove 44 between the outer edge 37 and the second slide web 41 which receives therein shutters or storm windows in cooperation with the upper sliding groove 27. The lower frame 29 includes a reinforcing partition 45 which depends in a vertical plane from the junction between the inner portion 39 and the first slide web 40 and which has a lower edge joined to the bottom member 36. The partition 45 thus defines on its indoor side a hollow space 46 of generally rectangular cross section and on its outdoor side, it defines another hollow space 47 which is of the inverted L shape in cross section. The lower frame 29 further includes a pair of longitudinally extending grooves 48 opening downwardly from the underside of the head member 38 and adapted to engage screws as will hereinafter be described. The bottom member 36 is also provided on its underside with a pair of like grooves 48 of like purpose.

The sash assembly $S_1$ further includes a pair of opposite side frame members 49 each defining the outer extremity for one of the window panel housing portions 5. Each side frame member 49 includes an outwardly bent inner end flange 50 extending along the outer surface of the post 4 and secured thereto by nails 51. The vertical side frame members 49 have a width sufficient to embrace the upper and lower frames 8 and 29 and are each formed at the outer edge with an inwardly directed flange 52. Each side frame member 49 has an upper end secured to the upper frame 8 by screws received in the grooves 28 and a lower end secured to the lower frame 29 by screws received in the grooves 48, whereby a rectangular outer peripheral framework for the sash assembly $S_1$ is formed.

The sash assembly $S_1$ further comprises a pair of vertical partition pillars 53 of rectangular, hollow construction in cross section. Each partition pillar 53 is located at the boundary between the window covering portion 1 and one of the window panel housing portions 5. The partition pillar 53 extends vertically between the upper and lower frames 8 and 29 and is secured to the outer surface of the post 2. The partition pillar 53 has a hollow interior shape 54 of rectangular cross section and includes an outer wall 55 facing outdoors. The outer wall 55 is formed with an outwardly projecting locking flange 56 approximately in its center along the height thereof. The locking flange 56 is approximately T-shaped in cross section and receives therein a mating flange projection 78 on a glazed window panel 64 as will hereinafter be described in further detail. The partition pillar 53 includes an inner side wall 57 shown at left in FIG. 2 and extending outwardly beyond the outer wall 55 to define a flange 58 of the inverted L shape in cross section. A sealing member 59 is provided in a groove defined between the flanges 56 and 58. The partition pillar 53 further includes an inner wall 60 contacting the outer surface of the post 2. The inner wall 60 projects in either direction beyond the inner side wall 57 and the outer side wall to form a pair of flanges 61 secured to the post 2 by nails 62. The partition pillar 53 further includes a pair of groove projections 63 which are provided one on the inner surface of each side wall and receive screws to secure the partition pillar 53 to the upper frame 8. Another pair of like grooves 63 are provided to secure the partition pillar 53 to the lower frame 29 by screws.

The sash assembly $S_1$ is provided with a pair of glazed window panels 64 each having an upper end received in the first sliding groove 25 of the upper frame 8 and a lower end supported on the first rail 42 on the lower frame 29. The glazed window panels 64 are movable toward each other to close the window opening W and away from each other to open it to its full width. Each glazed window panel 64 comprises an upper frame member 65, a lower frame member 66 and a pair of vertical side frame members 67 and 68 which are all of the hollow, box-like construction and are connected to one another to form a rectangular framework. A pane of glass 69 is fitted to the inner periphery of the framework by sealing material 70. One of the glazed window panels 64 has a pair of webs 71 extending from its inner side frame member 67 toward the other glazed window panel 64. The other glazed window panel 64 includes a pair of grooved flanges 73 each carrying a sealing member 72 thereon. The webs 61 are moved into the clearance defined between the flanges 73 to rest against the sealing members 72 as shown in FIG. 2 when the panels 64 are brought into their closed positions. The inner side frame member 67 of each panel 64 includes an integrally formed decorative member 74 on its indoor side. The glazed window panel 64 shown at right in FIG. 2 is provided with a key member 75 and the glazed window panel 64 shown at left is provided with a lock 76.

The outer side frame member 68 includes an inner wall 77 formed with an L-shaped locking flange 78 extending inwardly and engaged with the mating locking flange 56 on the partition pillar 53. A sealing member 79 is carried on the locking flange 78 and abuts against the locking flange 56. The frame member 68 further includes an outer side wall 80 which extends inwardly beyond the inner wall 77 to form an end flange 81. A sealing member 82 is provided between the locking flange 78 and the end flange 81 and has a free edge in sealing contact with the inner wall 55 of the partition pillar 53 as shown in FIG. 2.

Outwardly of the glazed window panels 64, there are provided a pair of screen windows 83 each having an upper end received in the second sliding groove 26 and a lower end supported on the second rail 43. The screen panels 83 are slidable toward and away from each other to close and open the window opening W. Each of the screen windows 83 comprises a rectangular framework formed by an upper frame member 84, a lower frame member 85, a pair of vertical side frame members 86 and a horizontal middle frame member 87 which are all of the hollow, box-like construction. A pair of wire nets 88 are fitted to the framework by fastening members 89.

Provided outwardly of the screen windows 83 are a pair of shutters or storm windows 90 each having an upper end received in the third sliding groove 27 of the upper frame 8 and a lower end supported within the lower sliding groove 44. Each shutter 90 comprises a framework formed by an upper frame member 91, a lower frame member 92, a pair of vertical side frame members 93 and a number of horizontal middle frame members 94. A number of corrugated plates 95 of light metal or alloy, such as aluminum, are fitted to the framework by fastening members 96. The shutters 90 are operated in a manner similar to the glazed window panels 64 or the screen windows 83 as hereinbefore described.

In order to open the window opening W to its full width, one of each of the glazed window panels 64, the screen windows 83 and the shutters 90 is moved to the right as viewed in FIG. 2 into one of the window panel housing portions 5 and the other glazed window panel 64, screen window 83 and shutter 90 are slid to the left into the other window panel housing portion 5. These three kinds of window panels may be operated either all together as described, or in any other manner largely variable with the requirements of the user to open or close the window opening W to its full width or in part or to any other extent as desired. Operation of the window sash assembly $S_1$ as hereinabove briefly explained may be apparent to any person skilled in the art without any more detailed description.

The shutters 90 may be replaced by a pair of glazed window panels in order to keep the indoor space bright, while shutting off any outdoor noise, even when the window opening W is completely closed. The sealing members 59, 79 and 82 perfectly closes any clearance space between the partition pillars 53 and the glazed window panels 64 upon full closure of the window to thereby prevent any infiltration of outdoor air and maintain the optimum effects of indoor air conditioning, whereby the resident can enjoy the maximum comfort especially during the winter months.

Moreover, as is evident from the foregoing disclosure, the window sash assembly $S_1$ of this invention can be easily mounted to the exterior wall surface at the window opening and, therefore, need not be manufactured to conform to the dimensions of the perimeter of any particular window opening. Thus, the window sash assembly of this invention may be quite adavantageously fabricated as an integral unitary structure which includes at least a pair of window panels and which is ready for mounting on the exterior wall surface. Furthermore, the partition pillars 53 provide a strong mounting support for the window sash assembly $S_1$ installed on the exterior wall surface of the window. Any localized load bearing on the lower frame 29, especially when all of the glazed window panels 64, screens 83 and shutters 90 are in their closed positions, is duly supported on the windowsill 7 through the base portion 30 and its upper flange 31. The upper flange extension 32 of the lower frame 29 assists in providing a rigid support for any such load.

As the upper flange 31 of the lower frame 29 and its extensions 32 are placed between the corresponding posts 2 and 4, the window sash assembly $S_1$ can be snugly installed on the exterior wall surface and maintained in place for ever without being undesirably displaced relative to the width of the window opening W. It will be understood that if there is any additional post between the posts 2 and 4, the upper flange extension 32 of the lower frame 29 may be interrupted for the width of any such additional post and fitted snugly between the posts 2 and 4 and any such additional post.

Each of the partition pillars 53 also serves as a stop for the corresponding glazed window panel 64 when the latter is moved into its closed position. This will be apparent from the foregoing description regarding the engagement of the locking flange 78 of the glazed window panel 64 with the mating flange 56 of the partition pillar 53. Thus, no overrun of either glazed window panel 64 will occur.

Figure 3:
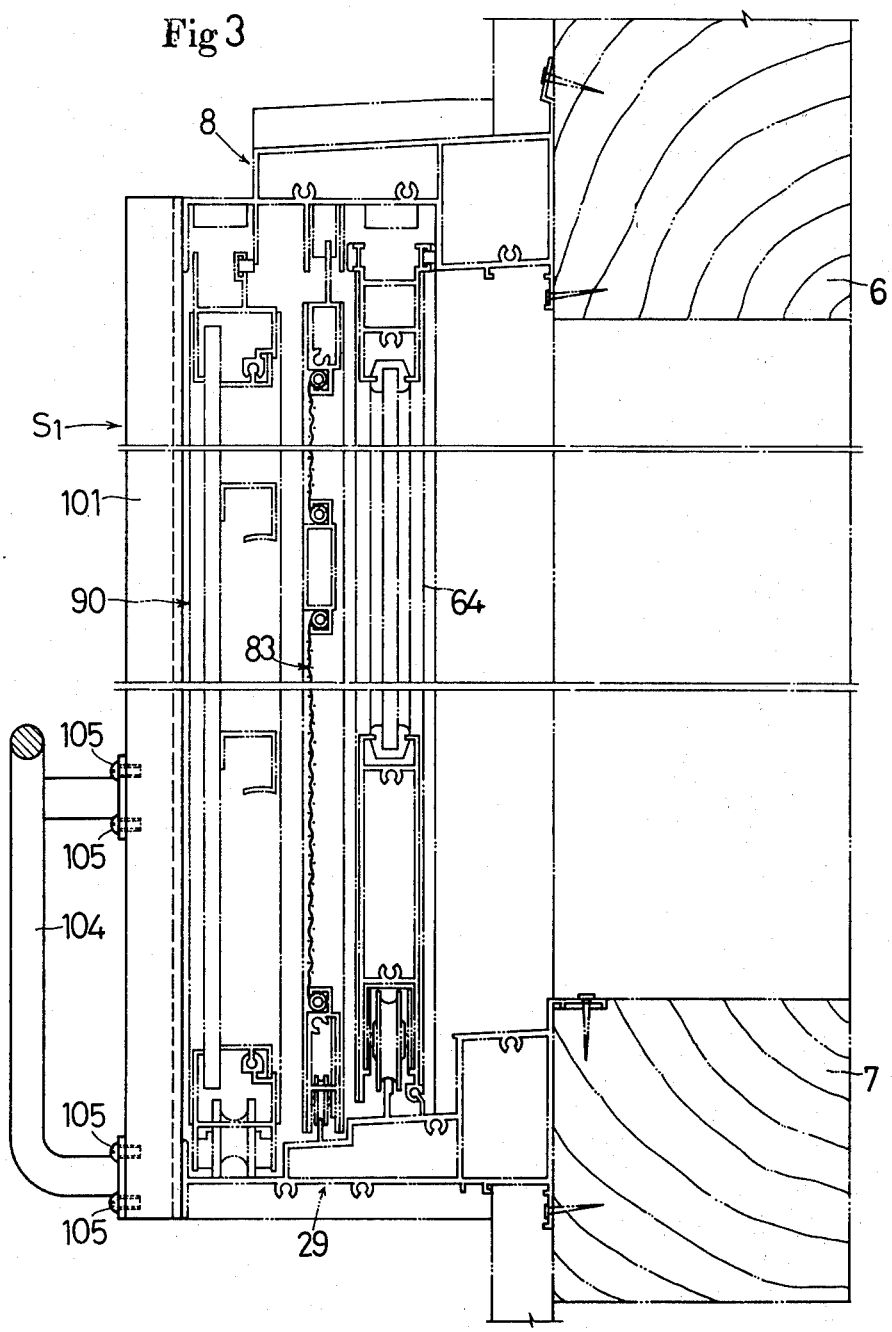
FIG. 3 is a partial vertical cross sectional view of a modification to the structure shown in FIG. 1.
Figure 4:
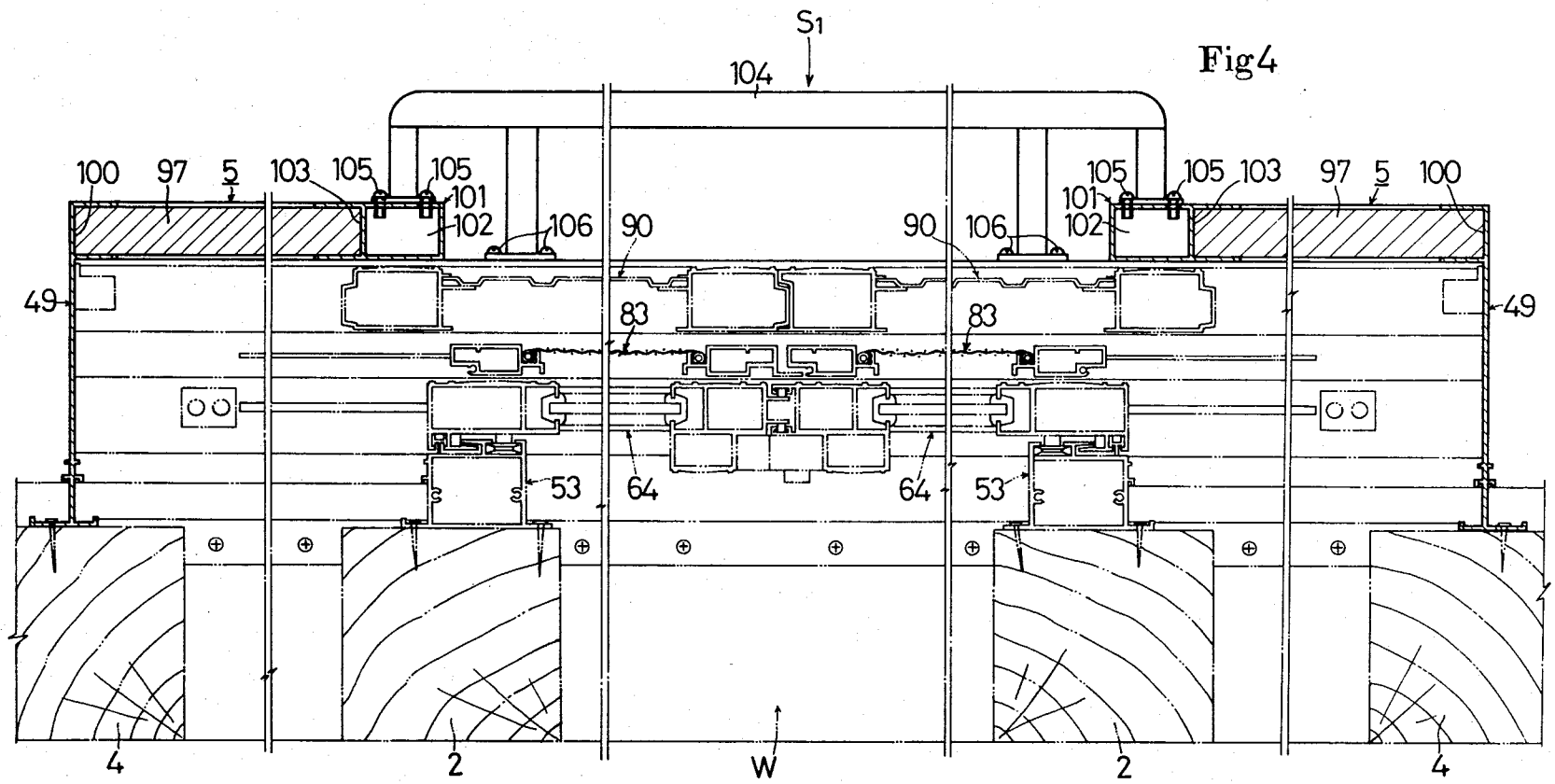
FIG. 4 is a partial horizontal cross sectional view of the structure shown in FIG. 3.
Figure 5:
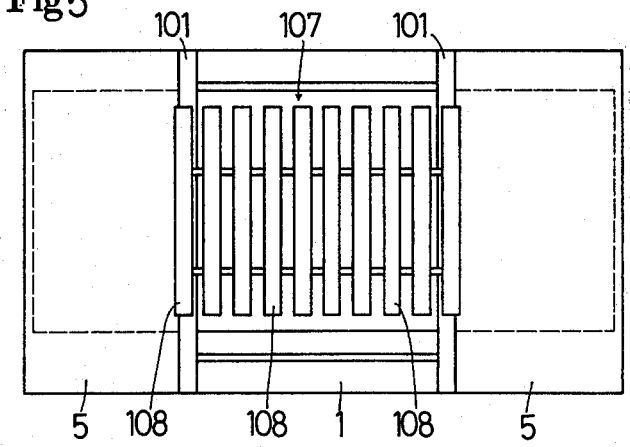
FIG. 5 is a schematic front elevational view of a further modification to the structure shown in FIG. 1.

FIGS. 3, 4 and 5 illustrate modification to the window sash assembly $S_1$. Each vertical side frame 49 of the sash assembly $S_1$ is modified to include a channel-shaped outer extension 100. A vertical frame member 101 is provided at the boundary between the window covering portion 1 and each window panel housing portion 5. The vertical frame member 101 is secured by screws or otherwise to the outer edges 19 and 37 of the upper and lower frames 8 and 19, respectively. Each vertical frame member 101 has a hollow interior space 102 of rectangular cross section and includes a channel-shaped extension 103 facing the channel-shaped extension 100 of the side frame 49. A front panel 97 is fitted between the channel-shaped extensions 100 and 103 and secured thereto by screws or otherwise.

The structure of FIGS. 3 and 4 includes a hand rail 104 of the grille-like construction installed in front of the lower part of the window covering portion 1. The hand rail 104 is secured to the vertical frame members 101 and the outer edge 37 of the lower frame 29 by screws 105 and 106.

The structure shown in FIG. 5 includes a grille or lattice 107 mounted in front of the window covering portion 1. The lattice 107 is formed by a plurality of elongate boards 108 and secured to the vertical frame members 101.

The front panel 97 installed outwardly of each window panel housing portion 5 provides improved protection against rain and wind.

Figure 6:
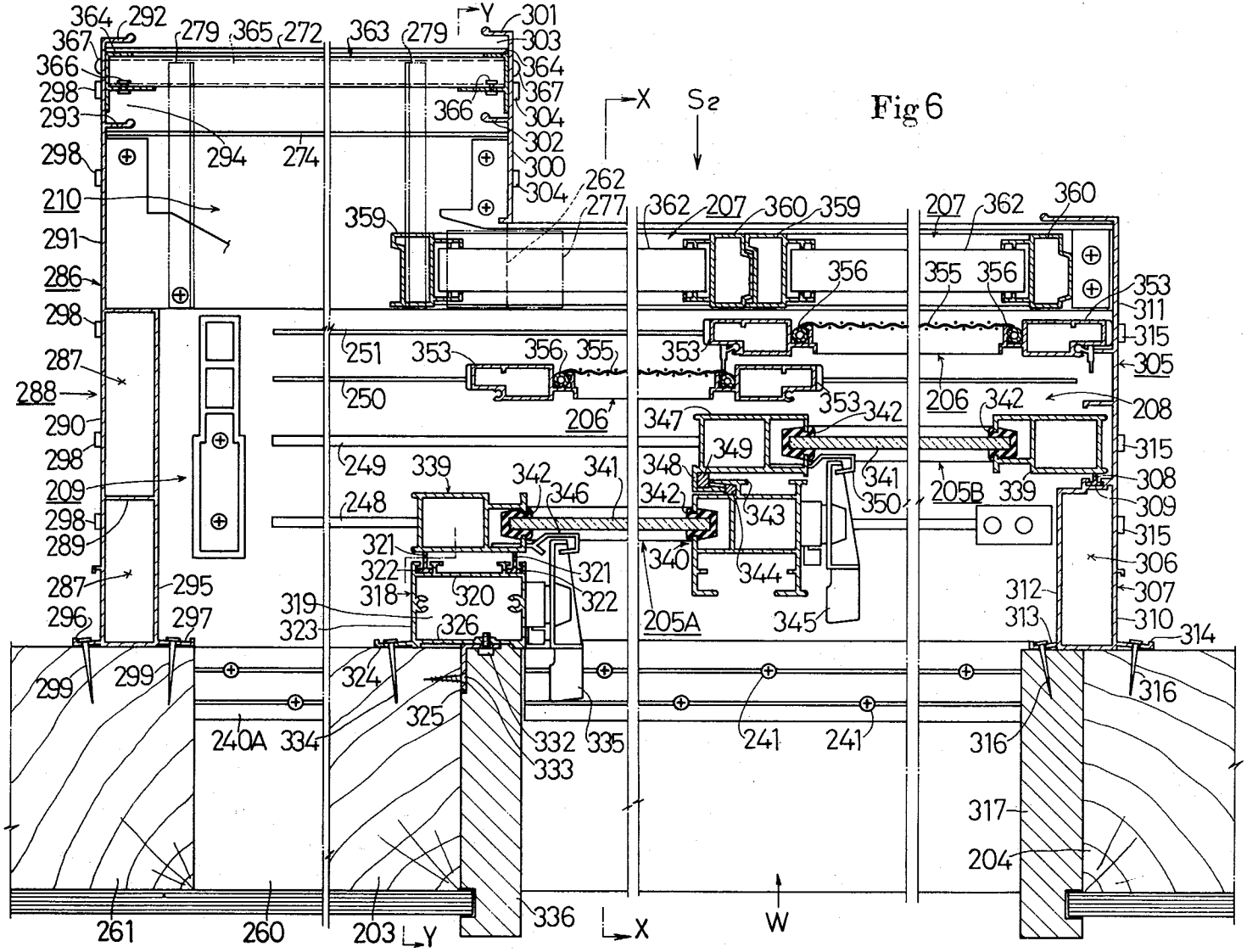
FIG. 6 is a partial horizontal cross sectional view of another embodiment of this invention.
Figure 7:
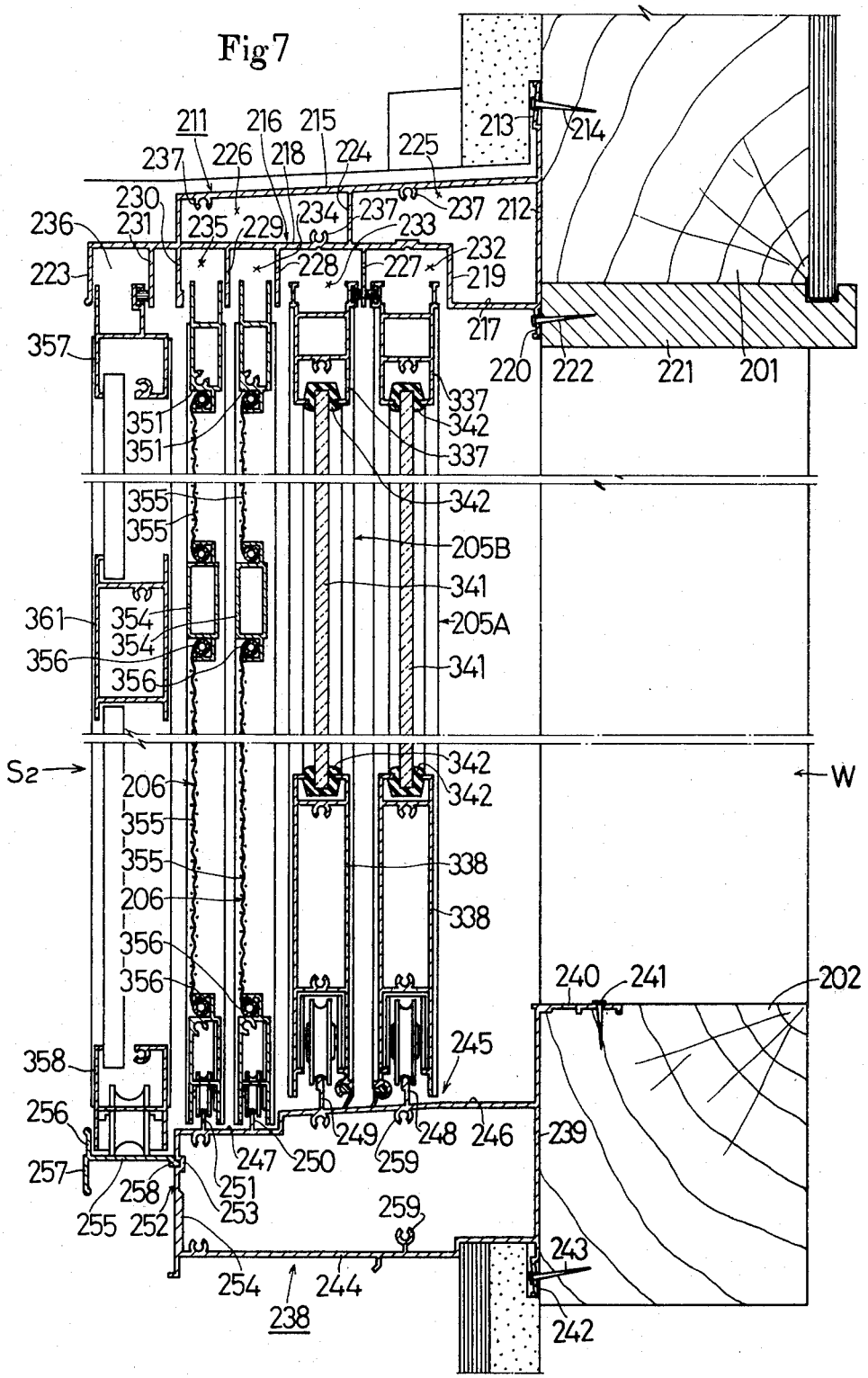
FIG. 7 is a partial sectional view taken along the line X—X of FIG. 6.
Figure 8:
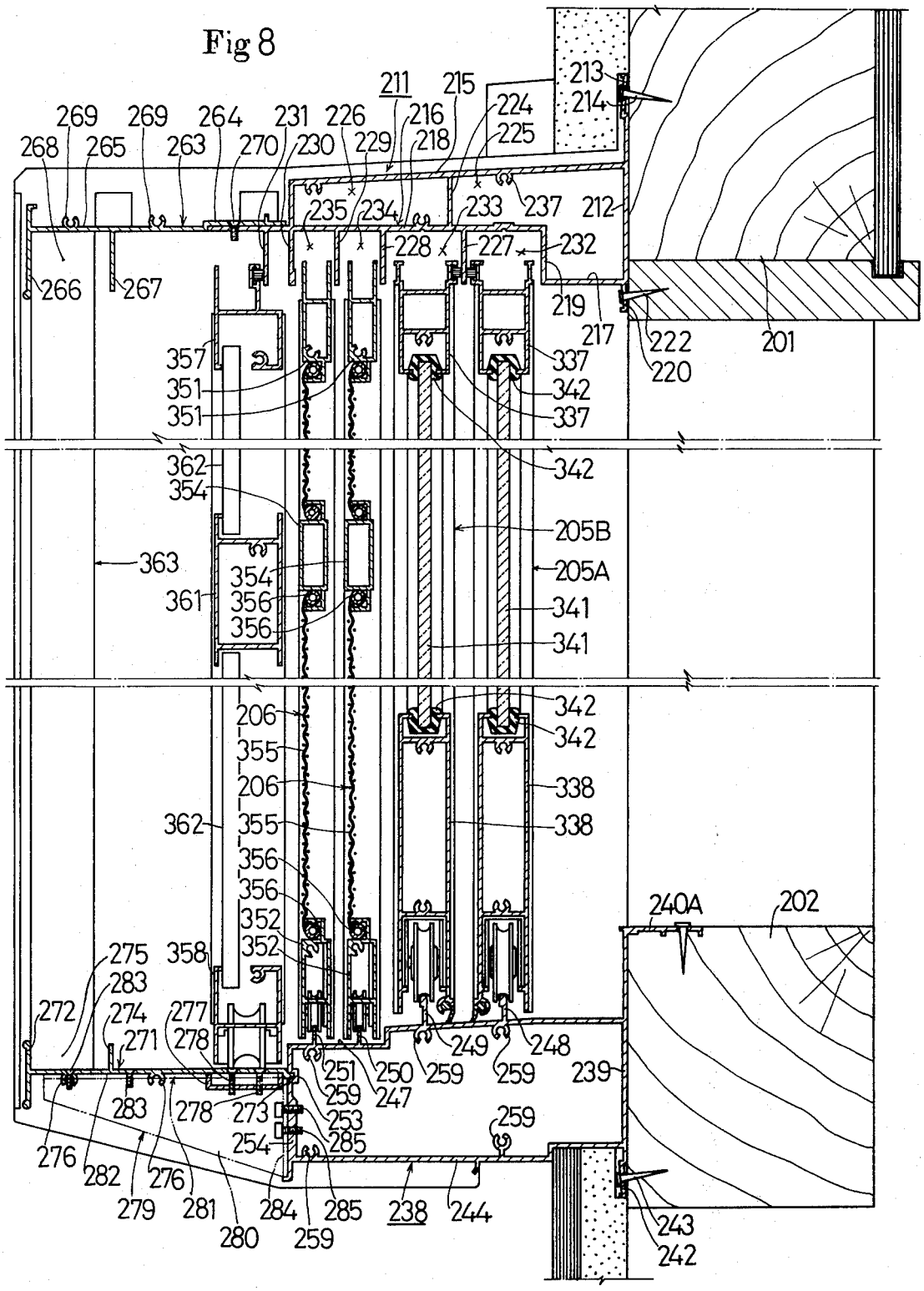
FIG. 8 is a partial sectional view taken along the line Y—Y of FIG. 6.

FIGS. 6, 7 and 8 of the drawings illustrate a window sash assembly $S_2$ according to a second embodiment of this invention. FIG. 6 shows a horizontal cross section of the window sash assembly $S_2$ mounted on an exterior wall surface at a window opening W defined by a lintel or head jamb 201, a windowsill 202 and a pair of vertical posts 203 and 204. In FIG. 6, the outdoor side of the window is shown at top and its indoor side at bottom. The window sash assembly $S_2$ comprises an integral framework formed by a window covering portion 208 facing the window opening W, a window panel housing portion 209 provided alongside the window covering portion 208 and adjacent to the exterior wall surface and a shutter box portion 210 provided outwardly of the window panel housing portion 209. The window panel housing portion 209 is adapted to receive therein a pair of glazed window panels 205A and 205B and a pair of screen windows 206 installed outwardly of the glazed window panels 205A and 205B when these window panels and screens are moved into their open positions. The shutter box portion 210 is adapted to receive therein a pair of shutters or storm windows 207 when the shutters 207 are slid into their open positions. The two glazed window panesl 205A and 205B are installed in different vertical planes from each other. Likewise, the two screen windows 206 are installed in different vertical planes from each other. The shutters 207 are mounted in a common vertical plane.

Referring to FIG. 7, in which the indoor side of the window is shown at right, the window sash assembly $S_2$ includes an upper frame 211 secured to the outer surface of the lintel 201 and extending outwardly to form a roof for the window covering portion 208 and the window panel housing portion 209. The upper frame 211 includes a vertical base portion 212 contacting the outer surface of the lintel 201. The base portion 212 has an upper edge 213 contacting the lintel 201 at an angle thereto and secured thereto by nails 214. The upper frame 211 includes a head member 215 which is slightly inclined outwardly and downwardly and which has an inner edge joined to the base portion 212. The outer edge of the head member 215 is downwardly bent to define a vertically depending outer edge joined to a slide web 218. The upper frame 211 further includes a bottom member 216 formed by a horizontal base web 217, a horizontal slide web 218 located at a higher level than the base web 217 and a vertical connecting web 219 connecting the base and slide webs 217 and 218. The base web 217 has an inner edge joined to the base portion 212 adjacent to the lower edge 220 of the latter. The lower edge 220 of the base portion 212 is secured by nails 222 to a decorative head 221 attached to the underside of the lintel 201. The slide web 218 extends outwardly beyond the vertical outer edge of the head member 215 and terminates in a downwardly bent, vertical depending outer edge 223.

The upper frame 211 further includes a vertical reinforcing partition 224 depending from the underside of the head member 215 and having a bottom edge joined to the upper surface of the slide web 218. The upper edge of the reinforcing partition 224 is joined to the head member 215 approximately halfway between the inner and outer edges of the head member 215. The partition 224 defines within the upper frame 211 a hollow space 225 of inverted L-shaped cross section on the indoor side thereof and another hollow space 226 of generally rectangular cross section. Five vertical partitions 227 to 231 depend from the underside of the slide web 218 and have an equal width. The connecting web 219 and the first depending partition 227 define therebetween a first sliding groove 232 for the inner glazed window panel 205A. The first and second partitions 227 and 228 define therebetween a second sliding groove 233 for the outer glazed window panel 205B. The second and third partitions 228 and 229 define therebetween a third sliding groove 234 for the inner screen window 206. The third and fourth partitions 229 and 230 define therebetween a fourth sliding groove 235 for the outer screen window 206. The fifth partition 231 and the outer edge 223 of the slide web 218 define therebetween a fifth sliding groove 236 which is an upper sliding groove for the shutters 207. The upper frame 211 further includes a plurality of longitudinally extending screw engaging grooves 237 provided on the lower surface of the head member 215 and on the upper surface of the bottom member 216. The grooves 237 are provided to receive screws for mounting a pair of side frames 286 and 305 for the sash assembly $S_2$ as will hereinafter be described in detail.

The window sash assembly $S_2$ further includes a lower frame 238 secured to the outer surface of the windowsill 202 and forming a floor for the window covering portion 208 and the window panel housing portion 209. The lower frame 238 includes a vertical base portion 239 contacting the outer surface of the windowsill 202. The base portion 239 has an upper edge which is bent in an indoor direction to form a horizontally extending mounting flange 240 contacting the upper surface of the windowsill 202 and secured thereto by nails 241. The base portion 239 has a lower edge 242 which is bent outwardly and then inwardly to contact the outer surface of the windowsill 202 at an angle thereto. The lower edge 242 is nailed to the windowsill 202 as at 243. The lower frame 238 further includes a bottom member 244 which has an inner edge joined to the base portion 239 and generally horizontally extends outwardly. The lower frame 238 also includes a head member 245 having an inner edge joined to the base portion 239 and formed by a first slide web 246 extending outwardly generally horizontally with a slight downward inclination, and a horizontally extending second slide web 247 which is located at a somewhat lower level of height than the first slide web 246 and integrally connected thereto by a vertical intermediate connecting portion.

A pair of rails 248 and 249 are provided on the first slide web 246 and support thereon the inner and outer glazed window panels 205A and 205B, respectively. Another pair of parallel rails 250 and 251 are provided on the second slide web 247 and support thereon the inner and outer screen windows 206. The rails 248 and 251 extend in parallel to one another longitudinally of the lower frame 238.

The lower frame 238 further includes a vertical outer edge member 252 having an upper end joined to the outer edge of the second slide web 247 and a lower end joined to the outer edge of the bottom member 244. The outer edge member 252 is formed on its inner surface with a pair of vertically spaced increased thickness portions 253 and 254. The upper increased thickness portion 253 defines on the opposite surface of the outer edge member 252 a horizontally extending groove 258 in which a third slide web 255 is received at its inner edge to support the shutters 207 thereon. The outer edge of the third slide web 255 lies substantially in the vertical plane of the outer edge 223 of the upper frame 211 and is formed with a pair of vertically projecting flanges 256 and 257. The upper flange 256 extends upwardly to define with the outer edge of the second slide web 247 a lower sliding groove for the shutters 207. The lower flange 257 extends downwardly. The lower frame 238 is further provided with a plurality of longitudinally extending screw receiving grooves 259 formed on the lower surface of the head member 245 and on the upper surface of the bottom member 244 for the purpose similar to that for which the grooves 237 are provided on the upper frame 211.

The window panel housing portion 209 is located on the outdoor side of the post 203, another post 261 and a wall 260 extending between the posts 203 and 261. The shutter box portion 210 is located outwardly of the window panel housing portion 209. The outer edge 223 of the upper frame 211 is interrupted on the outdoor side of the window panel housing portion 209 for a distance which is long enough to provide clearance space for mounting the shutter box portion 210. Likewise, the third slide web 255 is interrupted for the corresponding distance, whereby a connecting portion 262 is formed to connect the shutter box portion 210 and the third slide web 255. The upper flange 240 of the base portion 239 of the lower frame 238 is interrupted in the area between the posts 203 and 261 to form a mounting flange extension 240A secured to the windowsill 202 in the area between the posts 203 and 261.

An upper frame extension 263 is provided on the outdoor side of the window panel housing portion 209 and connected to the upper frame 211 to form a roof for the shutter box portion 210. The upper frame extension 263 comprises a horizontal base portion 264 secured to the top of the fifth sliding groove 236 of the upper frame 211, and a horizontal web 265 positioned at a slightly lower level than the base portion 264 and lying in the horizontal plane of the bottom member 216 of the upper frame 211. The web 265 outwardly extends and terminates in an outer edge downwardly bent to form a vertical flange 266 having an upper edge projecting above the level of the web 265. Inwardly of the flange 266, there is provided a partition 267 extending downwardly from the underside of the web 265 to define with the flange 266 a downwardly opening groove 268. A plurality of screw receiving grooves 265 are provided on the upper surface of the web 265 for the purpose which will hereinafter become clear. The base portion 264 is secured to the bottom member 216 of the upper frame 211 by screws 270.

A lower frame extension 271 is provided on the outdoor side of the window panel housing portion 209 and connected to the lower frame 238 to form a floor for the shutter box 210. The lower frame extension 271 has an equal width of horizontal outward extension to the upper frame extension 263 and terminates in a vertical outer end flange 272 lying in the vertical plane of the similar flange 266 on the upper frame extension 263. The lower frame extension 271 has an inner edge 273 which is L-shaped in cross section. An upright partition 274 is formed on the upper surface of the lower frame extension 271 and lies in the vertical plane of the partition 267 on the upper frame extension 263. The outer flange 272 and the partition 274 define an upwardly opening groove 275 therebetween. A plurality of screw receiving grooves 276 are formed on the underside of the lower frame extension 271 for the purpose which will hereinafter become clear.

The lower frame extension 271 has an inner lateral edge engaged with the connecting portion 262 adjacent to the third slide web 255 of the lower frame 238. The L-shaped inner edge 273 of the lower frame extension 271 is received in the groove 258 in the lower frame 238. The upper surfaces of the third slide web 255 and the lower frame extension 271 reside in a common horizontal plane in which the upper surface of the connecting portion 262 also lies. The connecting portion 262 includes a connecting member 277 of the upwardly open channel-shaped construction abutting on the lower surfaces of the third slide web 255 and the lower frame extension 271 and fastened thereby by screws 278. The connecting member 277 has an outer wall contacting the inner surface of the outer flange 257 of the third slide web 255, and an inner wall contacting the inner flange 273 of the lower frame extension 271 as shown in FIG. 8.

A pair of brackets 279 are provided to connect the lower frame extension 271 to the lower frame 238 to thereby support the shutter box 210. Each bracket 279 comprises a generally triangular body plate 280 and an inverted L-shaped connecting flange 281. The connecting flange 281 includes a horizontal portion 282 contacting the underside of the lower frame extension 271 and fastened thereto by a screw 283, and a vertical portion 284 contacting the outer flange 252 of the lower frame 238 and fastened to the lower increased thickness portion 254 of the outer flange 252 by screws 285.

The window sash assembly $S_2$ further includes a vertical side frame 286 fastened to the outer surface of the post 261 and extending outwardly to form a lateral edge for the window panel housing portion 209 and the shutter box 210. The side frame 286 includes a vertical hollow support 288 of rectangular cross section having a rectangular hollow space 287 therein. The hollow support 288 has a width of outward extension equal to the width of the upper and lower frames 211 and 238 and forms a side wall for the window panel housing portion 209. The hollow support 288 includes a vertical partition 289 dividing the hollow space 287 into two halves. The hollow support 288 has an outer side wall 290 extending outwardly beyond the window panel housing portion 209 to form a side wall 291 for the shutter box 210. The side wall 291 has an outer edge bent inwardly (to the right as viewed in FIG. 6) to define an outer flange 292. A partition 293 is provided inwardly of the outer flange 292 in parallel thereto to define a laterally inwardly open groove 294. The outer side wall 290 is formed along its inner edge with a laterally outwardly projecting mounting flange 296 contacting the outer surface of the post 261 at an angle thereto. The hollow support 288 further includes an inner side wall 295 having an inner edge formed with a laterally inwardly projecting mounting flange 297 contacting the outer surface of the post 261 at an angle thereto. The mounting flanges 296 and 297 are fastened to the post 261 by nails 299. The side frame 286 has an upper end fastened to the upper frame 211 and the upper frame extension 263 by screws 298 received in the screw engaging grooves 237 and 269. Likewise, the side frame 286 has a lower end fastened to the lower frame 238 and the lower frame extension 271 by screws 298 received in the screw engaging grooves 259 and 276.

The shutter box 210 has an inner side wall 300 having an inner edge engaged with the outer edges of the upper and lower frames 211 and 238 in the area of the connecting portion 262. The inner side wall 300 extends slightly beyond the outer side wall 291 and has an outer edge bent outwardly (to the left as viewed in FIG. 6) to form an outer flange 301. A partition 302 is formed inwardly of the outer flange 301 to define a laterally outwardly open groove 303 facing the groove 294 of the outer side wall 291. The inner side wall 300 has an upper end fastened to the upper frame extension 263 by screws 304 received in the screw engaging grooves 269, and a lower end secured to the lower frame extension 271 by screws 304 received in the screw engaging grooves 276.

The window sash assembly $S_2$ further includes another vertical side frame 305 forming a side wall for the window covering portion 208. The side frame 305 includes a vertical hollow support 307 of rectangular cross section having a rectangular hollow space 306 and secured to the post 204 at the window opening W. The hollow support 307 has an outer end wall having on its outer surface a dovetail groove 309 receiving a dovetail-shaped sealing member 308. The hollow support 307 has an outer side wall 310 extending outwardly beyond the outer end wall to define a side wall 311 for the window covering portion 208. The side wall 311 has an outer extremity which is bent inwardly or to the left as viewed in FIG. 6. The hollow support 307 has an inner side wall 312 formed with a slightly inclined mounting flange 313. Likewise, the outer side wall 310 is formed with a slight inclined mounting flange 314. The mounting flanges 313 and 314 are fastened to the post 204 by nails 316. The side frame 305 has an upper end secured to the upper frame 211 by screws 315 received in the screw engaging grooves 237, and a lower end fastened to the lower frame 238 by screws 315 received in the screw engaging grooves 259. Numeral 317 denotes a vertical decorative member attached to the inner lateral surface of the post 204.

Figure 9:
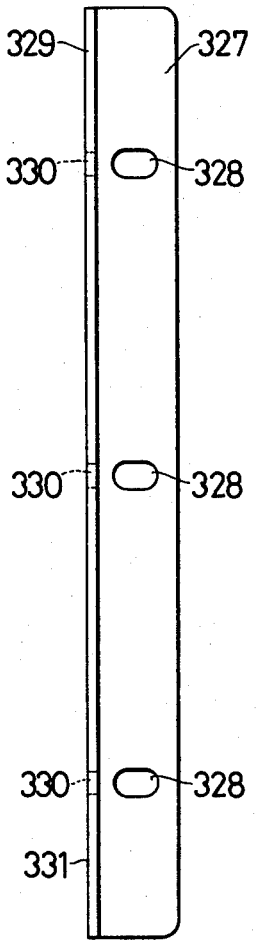
FIG. 9 is an enlarged front elevational view of the connecting member employed in the structure of FIG. 6.
Figure 10:
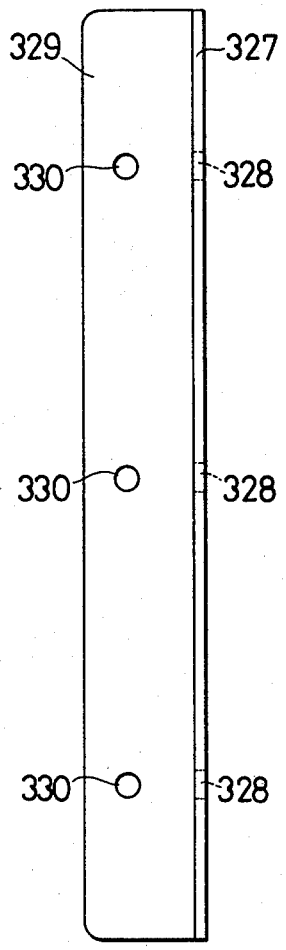
FIG. 10 is a side elevational view of the connecting member shown in FIG. 9.

The window sash assembly $S_2$ further comprises a vertical partition pillar 318 of rectangular hollow construction mounted between the upper and lower framrs 211 and 238 at the boundary between the window covering portion 208 and the window panel housing portion 209, and supported on the outer surface of the post 203 at the window opening W. The partition pillar 318 has a hollow inner space 319 of rectangular cross section. The partition pillar 318 has an outer end wall 320 formed on its outer surface with a pair of dovetail grooves 322 in each of which a dovetail-shaped sealing member 321 is received. The partition pillar 318 includes a side wall 323 formed with a laterally outwardly projecting mounting flange 324 contacting the outer surface of the post 203 at an angle thereto. The partition pillar 318 has an inner end wall 326 facing the post 203 and an adjustable connecting member 325 is attached to the inner end wall 326. The connecting member 325 has an inverted L-shaped configuration in cross section as shown in FIG. 6. The connecting member 325 has an outer portion 327 contacting the inner end wall 326 of the partition pillar 318 and an inner portion 329 contacting the inner lateral surface of the post 203. As shown in FIG. 9, the outer portion 327 is provided with three elongate holes 328. The inner portion 329 is provided with three circular holes 330 as shown in FIG. 10. Each of the holes 330 is positioned in the horizontal plane of one of the holes 328 as is obvious from FIGS. 9 and 10. The outer surface of the inner portion 329 provides a reference vertical plane 331 for mounting the sash assembly $S_2$ relative to the window opening W. The outer portion 327 is secured to the inner end wall 326 of the partition pillar 318 by screws 332 extending through the holes 328. The inner portion 329 is fastened to the post 203 by screws 333 extending through the holes 330. The mounting flange 324 is secured to the post 203 by nails 334. A lock 335 is provided on the inner side wall of the partition pillar 318. Numeral 336 indicates a vertical decorative member attached to the inner surface of the post 203.

The inner glazed window panel 205A comprises a rectangular framework formed by an upper frame member 337, a lower frame member 338 and a pair of vertical frame members 339 and 340. A pane of glass 341 is fitted to the framework by sealing material 342. The inner vertical frame member 340 is provided on its outdoor side with an inverted L-shaped locking member 343 in which a sealing member 344 is received. A lock 345 is provided on the inner vertical frame 340. The outer vertical frame 339 is provided with a lock hook 346 engageable by the lock 335 provided on the partition pillar 318.

The outer glazed window panel 205B comprises a rectangular framework formed by an upper frame member 337, a lower frame member 338 and a pair of vertical frame members 339 and 347. A pane of glass 341 is fitted to the framework by sealing material 342. The inner vertical frame 347 is provided on its indoor side with an L-shaped locking member 348 in which a sealing member 349 is provided and which is engageable with the locking member 343 on the inner panel 205A as shown in FIG. 6. The inner vertical frame 347 is also provided with a lock hook 350 engageable by the lock 345 on the inner panel 205A.

Each of the screen windows 206 comprises a rectangular framework formed by an upper frame member 351, a lower frame member 352, a pair of vertical frame members 353 and a horizontal middle frame member 354. A pair of wire nets 355 are fastened to the framework by fastening members 356. Each shutter 207 comprises a rectangular framework formed by an upper frame member 357, a lower frame member 358, a pair of vertical frame members 359 and 360 and a horizontal middle frame member 361. A pair of corrugated plates 362 of light metal or alloy, such as aluminum, are fitted to the framework.

The outer end of the shutter box 210 is closed by a front plate 363 formed by channel-shaped frame members 364 to which a corrugated plate 365 of light metal or alloy, such as aluminum, is riveted as at 366. The peripheral edges of the front plate 363 are held within the grooves 268, 275, 294 and 303 of the upper frame extension 263, the lower frame extension 271, and the side walls 286 and 300 of the shutter box 210, respectively.

It will be understood that the elongate holes 328 of the connecting member 325 will advantageously provide the necessary longitudinal (horizontal) positional adjustment for the window sash assembly $S_2$ to position it correctly relative to the window opening W.

The various components of the window sash assembly according to this invention may advantageously be formed from extruded aluminum or any other appropriate metal or alloy.

What is claimed is:

1. A window sash assembly for use on an exterior wall surface at a window opening defined by an upper lintel, a lower sill and side members, said window sash assembly comprising a rectangular framework formed by an upper horizontal frame member, a lower horizontal frame member and a pair of vertical side frame members extending between and engaged with the outer ends of the horizontal frame members, said framework including a window covering portion adapted to overlie the window opening and at least one window panel housing portion adapted to overlie the wall surface beside the window opening, and at least one partition pillar vertically oriented between the upper and lower horizontal frame member and defining, to the opposite sides thereof, the window covering portion and the window panel housing portion, said frame members and said partition pillar having generally planar inner faces mountable against an exterior wall surface, said upper horizontal frame member including downwardly facing upper slide web means, said lower horizontal frame member including upwardly facing lower slide web means in opposed cooperative relation to said upper slide web means, and at least one window panel positioned between and slidable along said upper and lower slide web means between the window covering portion and the window panel housing portion, the window panel being completely receivable within the window panel housing portion, said partition pillar having an outer face positioned immediately inward of the upper and lower slide web means for movement of the window panel thereacross in sliding between the window covering portion and the housing portion, said window panel, when in the window covering portion, including an outer side frame member overlying the outer face of the partition pillar, and sealing means engaged between the outer face of the partition pillar and the overlying outer side frame member of said window panel.

2. The window sash assembly of claim 1 wherein said lower horizontal frame member includes a vertical base portion defining the planar inner face thereof, and a generally horizontal inwardly directed upper edge flange on the base portion adapted to be received within the window opening in overlying relation to the sill for direct support therefrom.

3. The window sash assembly of claim 2 including a connecting member having a pair of right angularly related leg portions, means securing one of said leg portions to and longitudinally along the inner face of the partition pillar with the second of said leg portions projecting inwardly of the rectangular framework for positioning against a vertical wall member defining the window opening of an exterior wall surface.

4. The window sash assembly of claim 2 wherein said lower horizontal frame member includes a head member secured to and projecting outwardly from base portion below the upper edge of the base portion, at least a portion of said head member defining said lower slide web means, a bottom member secured to and projecting outwardly from the base portion below the head member and vertical means interconnecting said bottom member and said head member.

5. The window sash assembly of claim 4 wherein said upper horizontal frame member includes a vertical base portion having upper and lower edges and defining the planar inner face of the upper frame member, said upper frame member including vertically spaced head and bottom members projecting outwardly from the associated base portion respectively below and above the upper and lower edges thereof, and vertical means interconnecting the head and bottom members of the upper frame member, at least a portion of the bottom member of the upper frame member defining the upper slide web means.

6. The window sash of claim 5 wherein the head members of the upper and lower frame members incline downwardly, outward of the corresponding base portion.

7. The window sash assembly of claim 6 wherein said upper slide web means includes multiple downwardly opening sliding grooves, said lower sliding web means including a panel receiving and guiding means in vertical alignment with each sliding groove for the guided reception of a window panel therebetween, at least two additional spaced generally parallel window panels mounted between said upper and lower slide web means outward of the first mentioned window panel.

8. The window sash assembly of claim 7 including a connecting member having a pair of right angularly related leg portions, means securing one of said leg portions to and longitudinally along the inner face of the partition pillar with the second of said leg portions projecting inwardly of the rectangular framework for positioning against a vertical wall member defining the window opening of an exterior wall surface.

9. The window sash assembly of claim 7 including a shutter box mounted outward of the panel housing portion and in direct communication therewith for selective reception of the outermost window panel or panels, said shutter box being substantially coextensive with said panel housing portion.

10. The window sash assembly of claim 7 including a vertical intermediate frame member outward of the upper and lower slide web means and generally between the window covering portion and the window panel housing portion, and a panel engaged with the vertical intermediate frame member, overlying the housing portion outward thereof, and engaging the corresponding side frame member of the framework.

11. The window sash assembly of claim 7 wherein, outward from the base portion of the lower frame member, each panel receiving and guiding means is downwardly offset.

12. The window sash assembly of claim 8 including a window panel housing portion to each side of the window covering portion, at least one window panel being selectively completely received within each window panel housing portion.

13. The window sash assembly of claim 12 including a vertical intermediate frame member outward of the upper and lower slide web means and generally between the window covering portion and each window panel housing portion, and a rail-like construction secured to the vertical intermediate frame members and overlying the window covering portion immediately outward thereof.

* * * * *

UNITED STATES PATENT AND TRADEMARK OFFICE

CERTIFICATE OF CORRECTION

PATENT NO. : 4,057,937

DATED : November 15, 1977

INVENTOR(S) : Yoshihiro Nakamura

It is certified that error appears in the above-identified patent and that said Letters Patent are hereby corrected as shown below:

Column 5;
line 1, change "61" to --71--.

Column 8;
line 58, change "and" (second occurrence) to --to--.

Column 13;
line 12, change "member" to --members--.

Signed and Sealed this

Fourth Day of April 1978

[SEAL]

*Attest:*

RUTH C. MASON
*Attesting Officer*

LUTRELLE F. PARKER
*Acting Commissioner of Patents and Trademarks*